US009379483B2

(12) United States Patent
Suzuki

(10) Patent No.: US 9,379,483 B2
(45) Date of Patent: Jun. 28, 2016

(54) CONNECTOR WITH BACKLASH SUPPRESSION FUNCTION

(71) Applicant: Sumitomo Wiring Systems, Ltd., Yokkaichi, Mie (JP)

(72) Inventor: Masakazu Suzuki, Mie (JP)

(73) Assignee: SUMITOMO WIRING STSTEMS LTD. (JP)

( * ) Notice: Subject to any disclaimer, the term of this patent is extended or adjusted under 35 U.S.C. 154(b) by 0 days.

(21) Appl. No.: 14/661,081

(22) Filed: Mar. 18, 2015

(65) Prior Publication Data

US 2015/0295343 A1 Oct. 15, 2015

(30) Foreign Application Priority Data

Apr. 14, 2014 (JP) ..... 2014-082870

(51) Int. Cl.

| | |
|---|---|
| ***H01R 13/648*** | (2006.01) |
| ***H01R 13/629*** | (2006.01) |
| *H01R 13/639* | (2006.01) |
| *H01R 13/64* | (2006.01) |
| *H01R 13/627* | (2006.01) |

(52) U.S. Cl.

CPC ..... *H01R 13/629* (2013.01); *H01R 13/6272* (2013.01); *H01R 13/639* (2013.01); *H01R 13/64* (2013.01)

(58) Field of Classification Search

USPC ..... 439/383

See application file for complete search history.

(56) References Cited

U.S. PATENT DOCUMENTS

| | | | | |
|---|---|---|---|---|
| 7,458,838 | B2 * | 12/2008 | Itou | H01R 13/5208 439/271 |
| 7,588,454 | B2 * | 9/2009 | Nakata | H01R 13/6277 439/352 |
| 7,614,904 | B2 * | 11/2009 | Hiramatsu | H01R 13/641 439/352 |
| 7,641,502 | B2 * | 1/2010 | Itou | H01R 13/4364 439/383 |
| 8,029,310 | B2 * | 10/2011 | Shindo | H01R 13/533 439/350 |

FOREIGN PATENT DOCUMENTS

| | | |
|---|---|---|
| JP | 2008-166046 | 7/2008 |

* cited by examiner

*Primary Examiner* — Tho D Ta

(74) *Attorney, Agent, or Firm* — Gerald E. Hespos; Michael J. Porco; Matthew T. Hespos

(57) ABSTRACT

Ribs (71) of a front member (60) can suppress backlash between first and second housings (10, 30) by coming into contact with the inner peripheral surface of a receptacle (12) when the first and second housings (10, 30) are connected properly. A tapered surface (18) is provided on the inner peripheral surface of the receptacle (12) and is inclined in a direction to gradually reduce inner dimensions of the receptacle (12) from an intermediate position of this receptacle (12) in a depth direction toward a back end. Each rib (71) has a curved surface cross-section and is formed to gradually increase a height from a front end in a fitting direction toward a rear end and includes an inclined portion (74) configured to come into contact along the tapered surface (18) of the receptacle (12) as the first and second housings (10, 30) are connected properly.

10 Claims, 8 Drawing Sheets

CONNECTOR WITH BACKLASH SUPPRESSION FUNCTION

BACKGROUND

1. Field of the Invention

The present invention relates to a connector.

2. Description of the Related Art

Japanese Unexamined Patent Publication No. 2008-166046 includes a male housing with a tubular small receptacle, a female housing with a tower to be fit into the small receptacle and a front wall to be assembled with the tower to cover the front surface of the tower. Backlash preventing ribs are provided at circumferential intervals on the outer peripheral surface of the front wall and extend in a front-back direction. Fitting grooves are provided on the inner peripheral surface of the small receptacle and the backlash preventing ribs are fit therein. Each backlash preventing rib has a triangular cross-section and the fitting groove has a trapezoidal cross-section. Both sides of the backlash preventing ribs and corresponding opening edges of the fitting grooves squeeze each other when the tower is fit to a proper depth into the small receptacle to suppress backlash between the male and female housings.

The backlash preventing ribs and surfaces of the fitting grooves squeeze each other from an intermediate stage of fitting the tower into the small receptacle to completion of the fitting. Thus, sliding resistance is large and operability may deteriorate. Further, pointed tips of the backlash preventing ribs may scrape off during transportation or the like, and a backlash suppressing function may not be obtained due to difficulty in strictly managing squeezing amounts of the backlash preventing ribs.

The invention was completed based on the above situation and aims to provide a connector having good operability at the time of connection and capable of properly exhibiting a backlash suppressing function.

SUMMARY OF THE INVENTION

The invention is directed to a connector, including a first housing with a tubular receptacle, a second housing with a main body to be fit into the receptacle, and a front member to be assembled with the main body to cover the front surface of the main body and to fit into the receptacle together with the main body. Ribs are provided at circumferentially spaced positions on the outer peripheral surface of the front member and extend along a fitting direction of the main body into the receptacle. The ribs contact the inner peripheral surface of the receptacle when the first and second housings are connected properly to suppress backlash between the first and second housings. A tapered surface is provided on the inner peripheral surface of the receptacle and is inclined to gradually reduce inner dimensions of the receptacle from an intermediate position of the receptacle in a depth direction toward a back end. Each rib has a curved surface cross-section perpendicular to the fitting direction and is formed to gradually increase a height from a front end part in the fitting direction toward a rear side. Each rib includes an inclined portion configured to contact along the tapered surface portion of the receptacle as the first and second housings are connected properly.

According to the above configuration, the inclined portions of the ribs contact along the tapered surface of the receptacle as the first and second housings are connected properly. Thus, sliding resistance due to sliding movements of the ribs along the inner peripheral surface of the receptacle hardly is produced in the process of connecting the first and second housings. Thus, operability at the time of connection is improved. Further, the ribs have a curved surface cross-section. Thus, tip parts of the ribs in a projecting direction are not scraped off during transportation and the intended backlash suppressing function is assured.

The inclined portions of the ribs and the tapered surface of the receptacle have substantially the same angle of inclination with respect to a reference line along the fitting direction. Thus, contact of the inclined portions of the ribs and the tapered surface of the receptacle on an inclined line corresponding to the angle of inclination is ensured and backlash between the first and second housings is suppressed more satisfactorily.

The inclined portions of the ribs are in contact with the tapered surface of the receptacle without being squeezed significantly when the first and second housings are connected properly. Thus, an operation force for squeezing the inclined portions of the ribs is not required and operability at the time of connection is improved.

DETAILED DESCRIPTION

An embodiment of the invention is described with reference to FIGS. 1 to 9. A connector of this embodiment includes first and second housings 10, 30 connectable to each other and a front member 60 to be assembled with the second housing 30. In the following description, ends of the first and second housings 10, 30 facing each other when starting connection are referred to as front ends concerning a front-back direction. A vertical direction is based on the respective figures except FIGS. 4 and 6 and a width direction is synonymous with a lateral direction of FIGS. 3 and 5.

Figure 9:
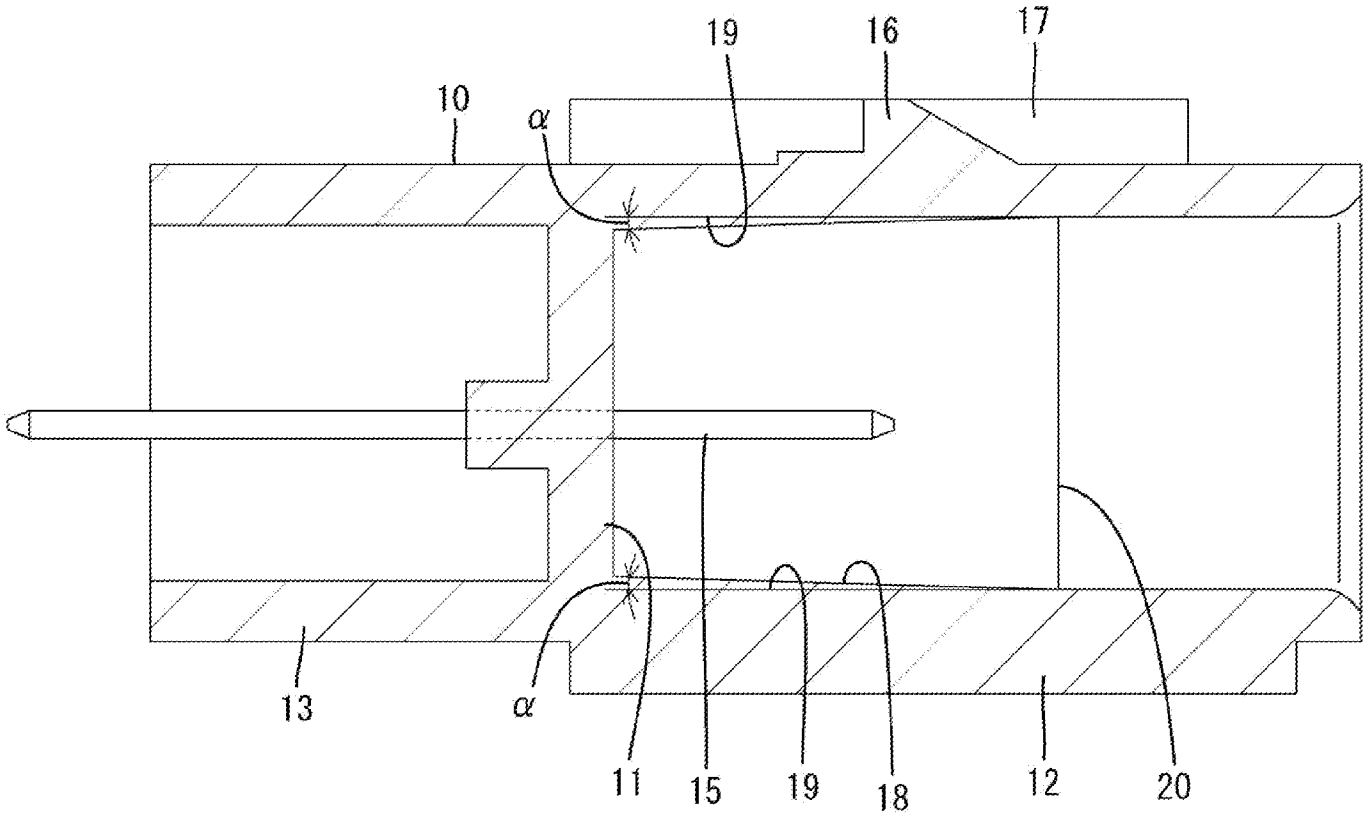
FIG. 9 is a section of the first housing.

The first housing 10 is made of synthetic resin and, as shown in FIG. 9, composed of a standing wall 11 extending in the vertical direction, a tubular receptacle 12 projecting forward from the outer peripheral edge of the standing wall 11 and a tubular rear tube 13 projecting back from the outer peripheral edge of the standing wall 11. Pin-like male terminal fittings 15 penetrate through the standing wall 11 in the front-back direction and front parts of the male terminal fittings 15 project into the receptacle 12. Further, rear parts of the male terminal fittings 15 project into the rear tube 13 and rear ends thereof are exposed behind the rear tube 13.

As shown in FIG. 9, a lock 16 projects on an upper part of the outer peripheral surface of the receptacle 12. Further, protection walls 17 are provided at opposite widthwise sides of the lock 16 on the outer peripheral surface of the receptacle 12. The protection walls 17 extend in the front-back direction (fitting direction) and cover opposite widthwise sides of the lock 16.

As shown in FIG. 9, a tapered surface 18 is provided on the inner peripheral surface of the receptacle 12 and tapers to gradually reduce inner dimensions of the receptacle 12 from an intermediate position slightly before a center in the front-back direction (base line 20) to a back end of the receptacle 12 at the standing wall 11. The tapered surface 18 is provided over the entire inner peripheral surface of the receptacle 12 and has a constant moderate angle of inclination $\alpha$ with respect to a reference line 19 extending in the front-back direction from the base line 20 toward the back end of the receptacle 12. The front end of the tapered surface 18 is forward of the lock 16.

Figure 1:
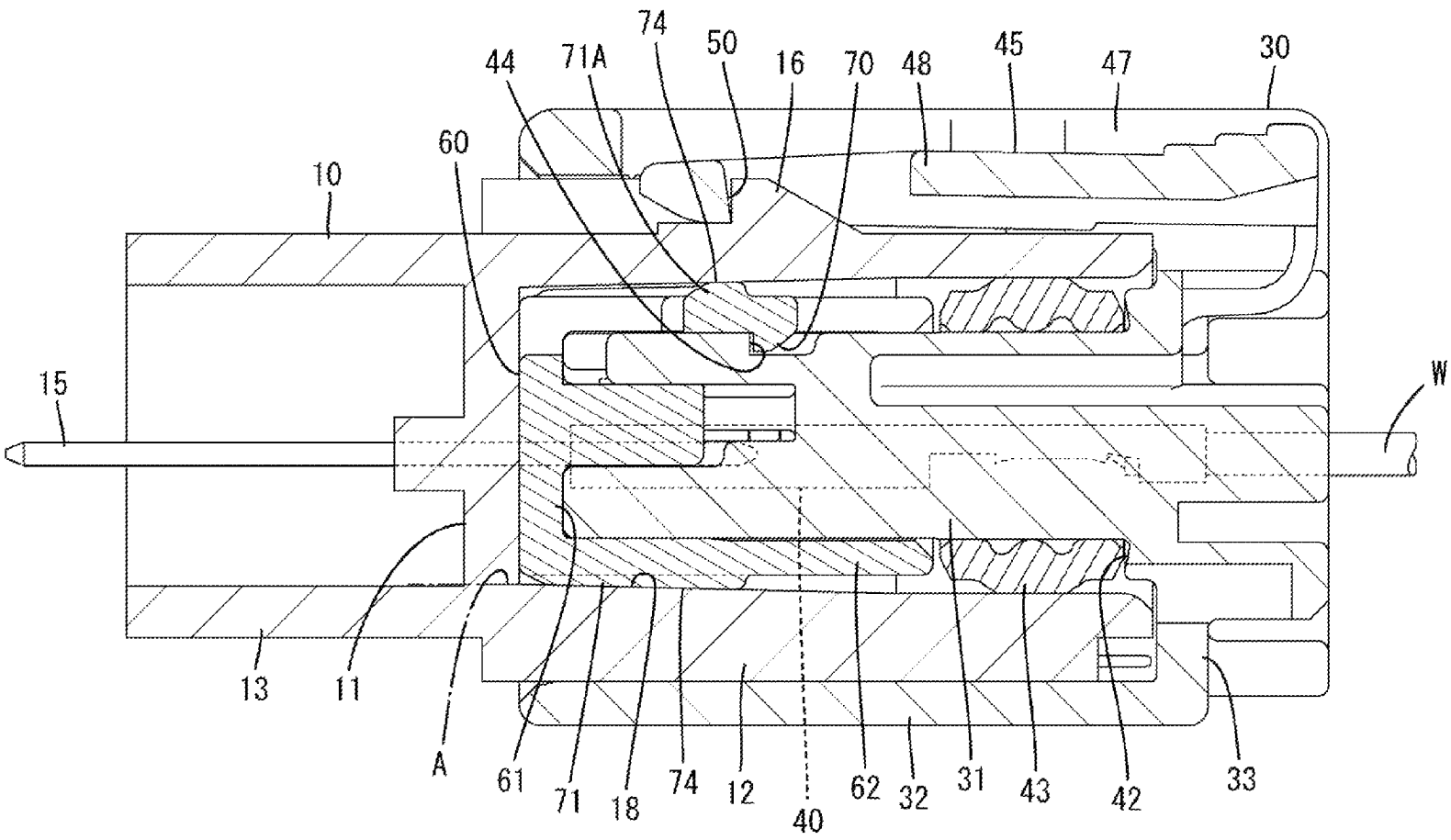
FIG. 1 is a section showing a state where first and second housings are properly connected in a connector of one embodiment of the present invention.
Figure 2:
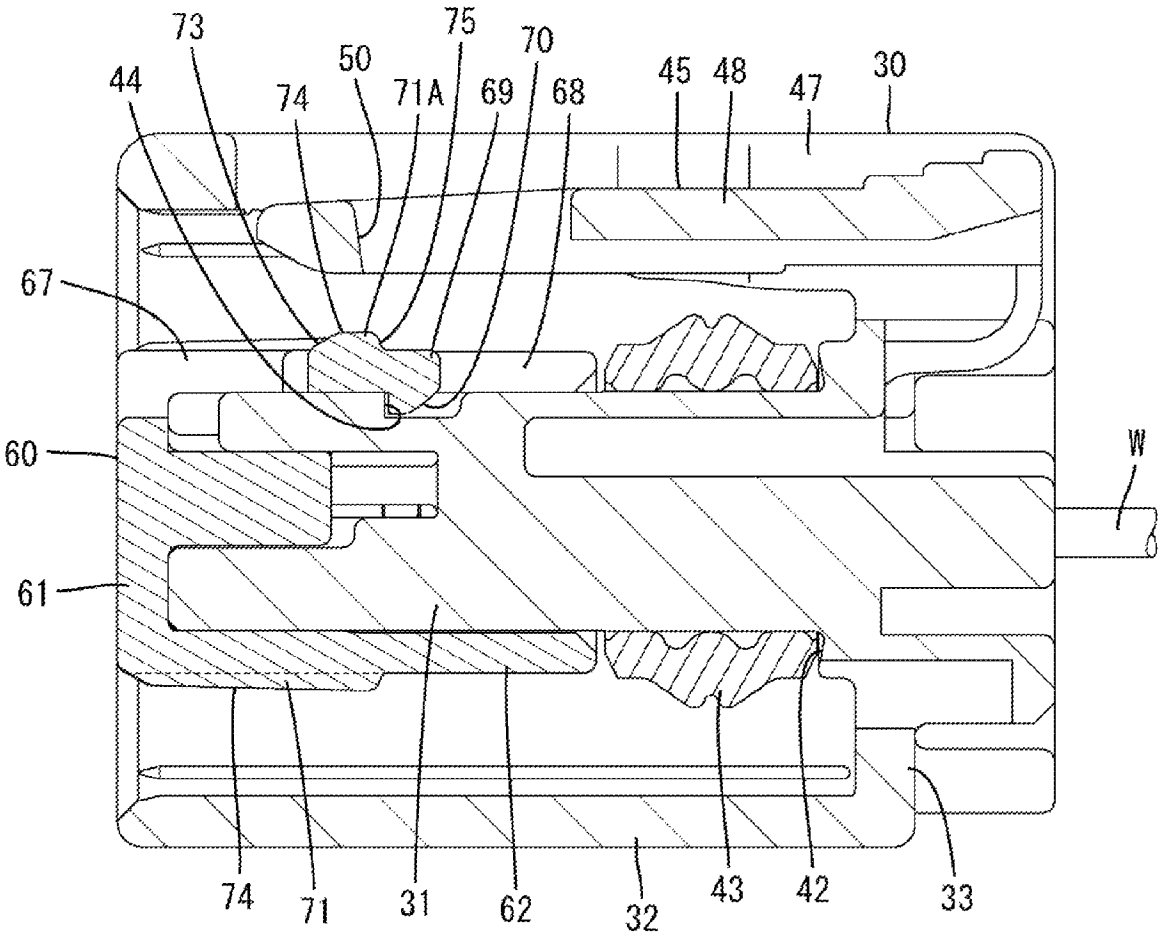
FIG. 2 is a section showing a front member assembled with a housing main body.
Figure 3:
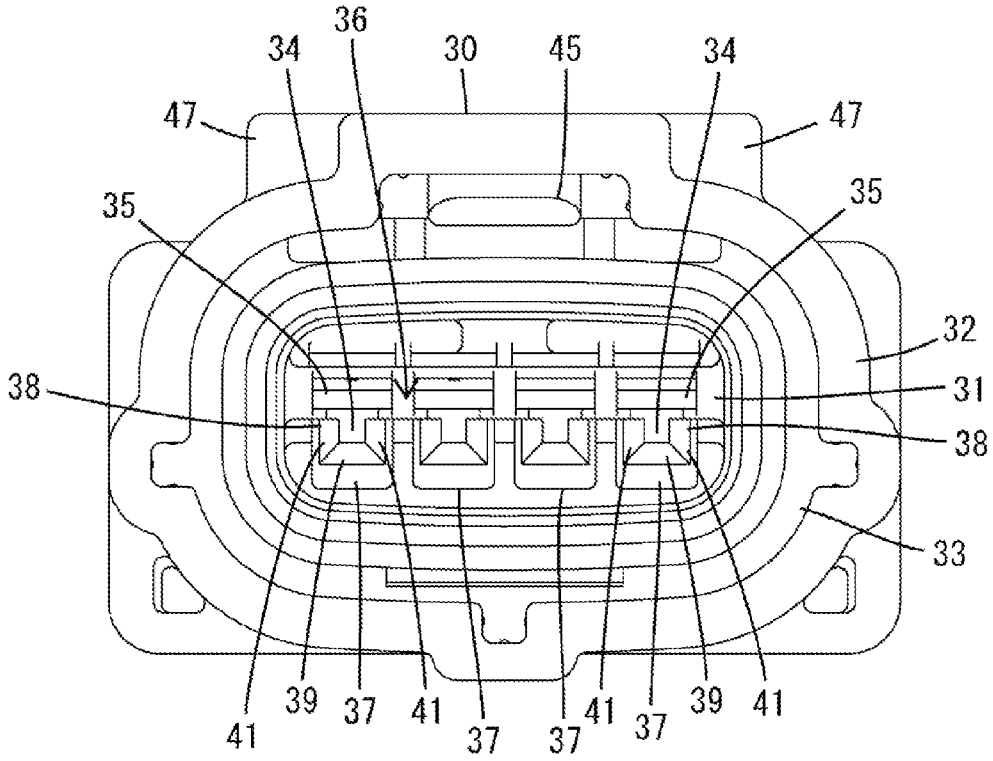
FIG. 3 is a front view of the second housing.

The second housing 30 is made of synthetic resin and, as shown in FIGS. 2 and 3, has a block-like main body 31, a fitting tube 32 surrounding the outer periphery of the main body 31, and a radially extending coupling 33 that couples rear end parts of the fitting tube portion 32 and the main body 31. As shown in FIG. 3, cavities 34 are provided in the main body 31 and are arranged in a row in the width direction in the main body 31. A resilient locking lance 35 projects from an inner wall upper surface of each cavity 34. A female terminal fitting 40 is inserted into each cavity 34 from behind and the properly inserted female terminal fitting 40 is retained by the locking lance 35. As shown in FIG. 1, the female terminal fitting 40 is connected to an end part of a wire W and the connected wire W is drawn out backward from the rear surface of the main body 31. Further, the female terminal fittings 40 are connected electrically conductively to the male terminal fittings 15 when the first and second housings 10, 30 are connected properly.

As shown in FIG. 3, the main body 31 is provided with mold removal holes 36 that expose the locking lances 35 forward, due to removal of an unillustrated mold for forming the locking lances 35. Further, the main body 31 has cavity towers 37 below the mold removal holes 36. The cavity towers 37 are arranged side by side in the width direction at positions corresponding to the respective cavities 34. A guiding surface 38 is provided on the front surface of the cavity tower 37 and widens toward the front to guide the mating male terminal fitting 15 into the cavity 34. The guiding surface 38 is substantially U-shaped in a front view and has a lower side 39 and two lateral sides 41 standing up from opposite ends of the lower side 39.

As shown in FIG. 2, a step 42 is provided on the outer peripheral surface of the main body 31 before the coupling 33 and a seal ring 43 is fit in contact with the step 42. As shown in FIG. 1, the seal ring 43 is sandwiched resiliently between the main body 31 and the receptacle 12 to seal between the first and second housings 10, 30 in a liquid-tight manner when the first and second housings 10, 30 are connected properly. Further, a lock 44 is recessed on the upper surface of the main body 31 and is lockable to a later-described locked portion 70 of the front member 60.

Figure 4:
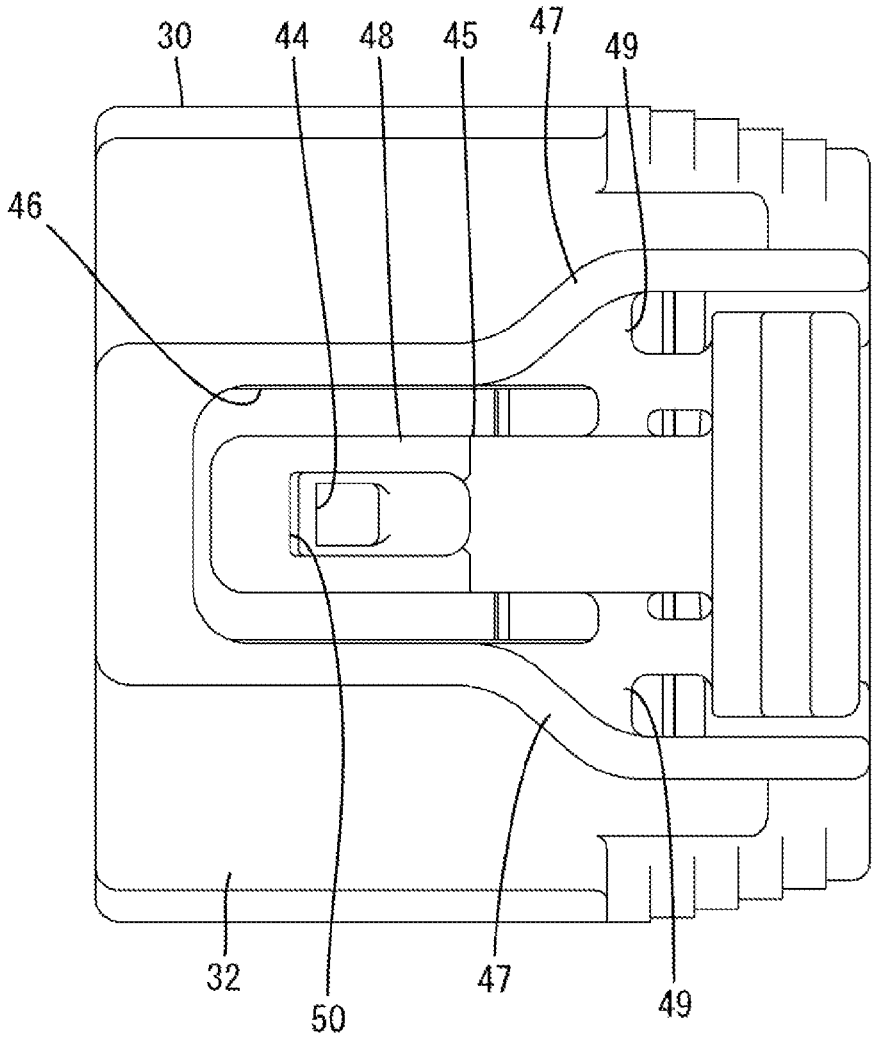
FIG. 4 is a plan view of the second housing.

As shown in FIG. 2, a deflectable lock arm 45 is arranged above the main body 31. As shown in FIG. 4, an opening 46 is provided on an upper part of the fitting tube 32 and the lock arm 45 is exposed through the opening 46 to enable visual confirmation. Further, two side walls 47 defining the opening 46 are erected on the upper part of the fitting tube 32. The lock arm 45 includes a strip-like arm main body 48 extending in the front-back direction and two wings 49 bulging out from opposite side edges of the arm main body 48 and connected to the side walls 47. A lock hole 50 penetrates a front end part of the arm main body 48. As shown in FIG. 4, the locking portion 44 can be visually confirmed through the lock hole 50 from above.

In the process of connecting the first and second housings 10, 30, the lock 16 interferes with the front end of the arm main body 48 so that the arm main body 48 is deflected with the both wings 49 as supports. When the first and second housings 10, 30 are connected properly, as shown in FIG. 1, the arm main body 48 is restored resiliently and the lock 16 is fit into the lock hole 50 to hold the first and second housings 10, 30 in a connected state.

The front member 60 is made of synthetic resin and, as shown in FIGS. 2 and 5 to 7, includes a front wall 61 in the form of a flat plate extending in the vertical direction and a tubular peripheral wall 62 projecting back from the outer periphery of the front wall 61. As shown in FIG. 2, the front member 60 is assembled with the main body 31 from the front and is arranged to cover the front surface of the main body 31 and the peripheral wall 62 is arranged to cover the outer peripheral surface of the main body 31.

Figure 5:
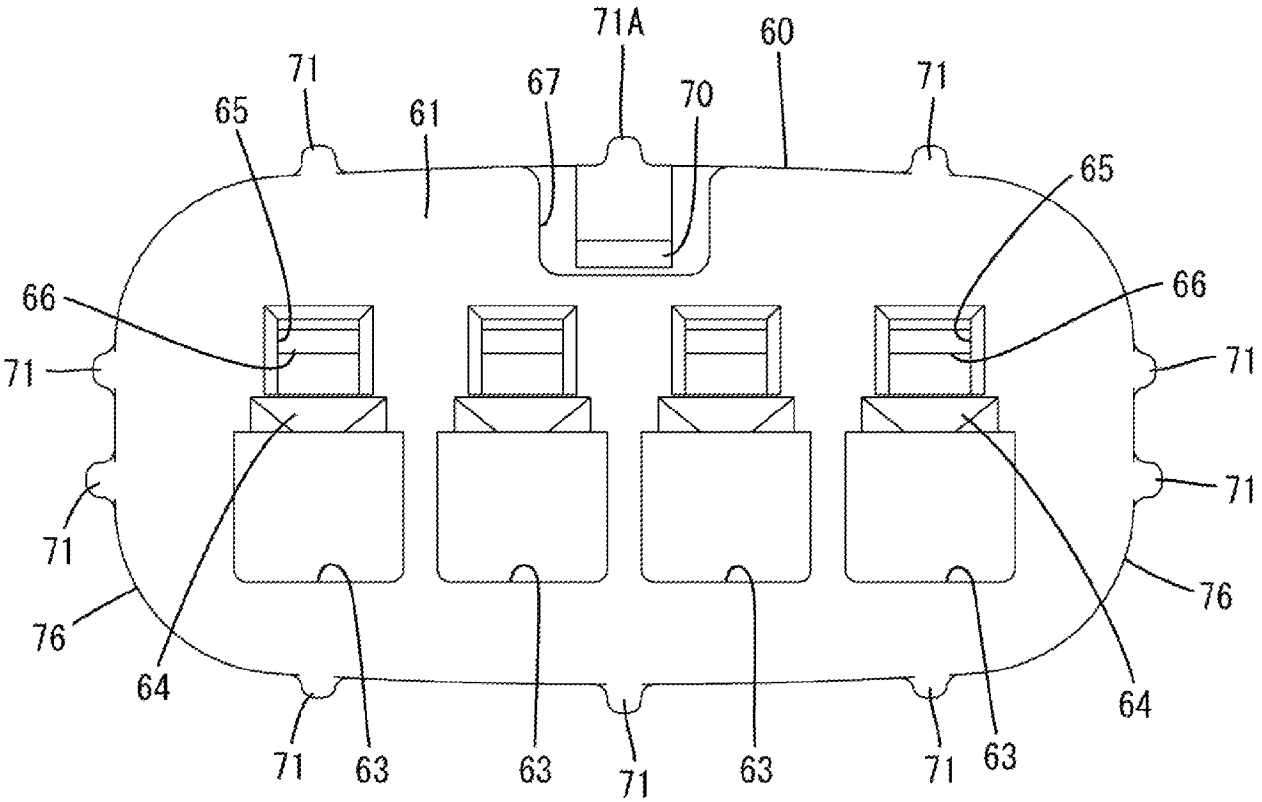
FIG. 5 is a front view of the front member.

As shown in FIG. 5, the front wall 61 has through holes 63 arranged side by side in the width direction at positions corresponding to the respective cavity towers 37. The through holes 63 are substantially rectangular openings in conformity with the cross-section of the cavity towers 37. When the front member 60 is assembled with the main body 31, the front surfaces of the corresponding cavity towers 37 are exposed in the respective through holes 63.

Further, as shown in FIG. 5, the front wall 61 is provided with upper sides 64 extending along the upper edges of the respective through holes 63. The upper side 64 is widened forward, and connected to the upper ends of both lateral sides 41 of the guiding surface 38 of the cavity tower 37 to form a guiding surface closed in the circumferential direction due to the front surface of the cavity tower 37 located in the through hole 63. Thus, the tip (right-side terminal in FIG. 9) of the male terminal fitting 15 can be inserted into the cavity 34 while sliding in contact with any one of the upper side 64, the lower side 39 and the lateral sides 41 in the process of connecting the first and second housings 10, 30.

As shown in FIG. 5, window holes 65 are provided on the front wall 61 and open at positions opposite the through holes 63 across the upper sides 64. The window holes 65 are substantially rectangular openings with smaller opening dimensions than the through holes 63. Further, retaining pieces 66 are provided on the rear surface of the front wall 61 and project back from upper edges of the respective window holes 65. When the front member 60 is assembled with the housing main body 31, the retaining pieces 66 are inserted into the mold removal holes 36 and deflection spaces for the locking lances 35 to restrict deflecting movements of the locking lances 35. Thus, the female terminal fittings 40 are held doubly in the cavities 34 of the main body 31. Further, an unillustrated tool such as a probe pin can be inserted through the window hole 65 and brought into contact with the female terminal fitting 40 in the cavity 34.

Figure 6:
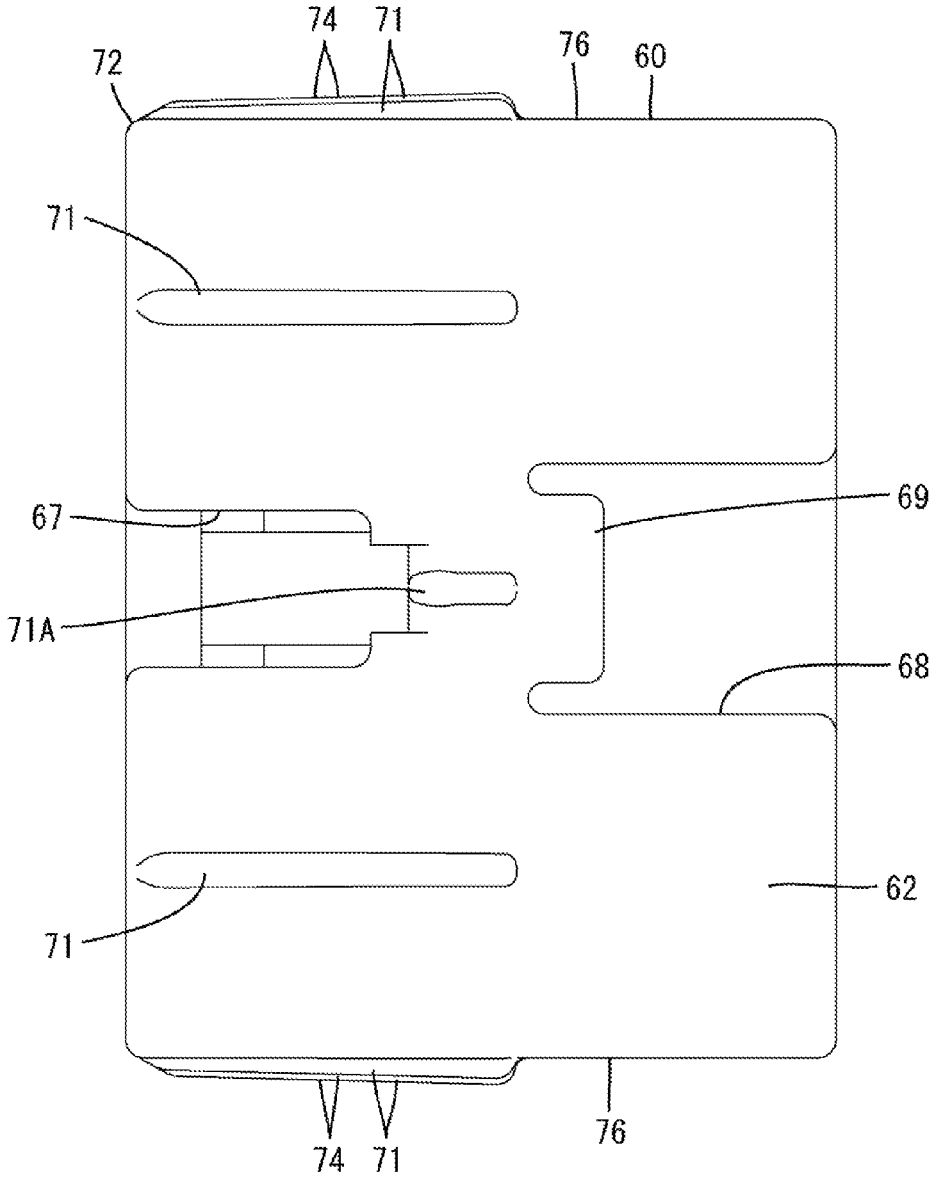
FIG. 6 is a plan view of the front member.

As shown in FIGS. 2, 5 and 6, a front opening 67 open forward, a rear opening portion 68 open backward and a deflectable bridge 69 bridges between opposite widthwise end parts of the upper wall between the front opening 67 and the rear opening 68 are provided in a widthwise central part of the upper wall of the peripheral wall 62. The bridge 69 is arranged substantially in a central part of the peripheral wall 62 in the front-back direction. As shown in FIG. 2, the claw-like locked portion 70 projects on the inner surface (lower surface) of the bridge 69. When the front member 60 is assembled properly with the housing main body 31, the locked portion 70 is fit resiliently into the locking portion 44 after the bridge 69 is deflected, with the result that the front member 60 is retained and held in the main body 31.

As shown in FIGS. 5 to 8, ribs 71 are provided at circumferentially spaced positions on the outer peripheral surface of the peripheral wall 62 of the front member 60. The ribs 71 are elongated projections extending in the front-back direction (fitting direction) and the front ends thereof, except the rib located in the widthwise central part of the upper wall of the peripheral wall portion 62 (hereinafter, referred to as a short rib 71A), are connected integrally to a chamfered portion 72 in the form of a curved surface on the front end of the outer periphery of the front member 60, whereas the rear ends thereof are slightly behind a central part of the front member 60 in the front-back direction. Three ribs 71 are arranged at intervals in the width direction on the outer surface of each of the upper and lower surfaces of the peripheral wall 62 and two ribs 71 are arranged at an interval in a height direction (vertical direction) on the outer surface of each of opposite side surfaces 76 of the peripheral wall 62. Thus, the ribs 71 are arranged at substantially point-symmetrical positions with respect to a center of the front wall 61.

Figure 7:
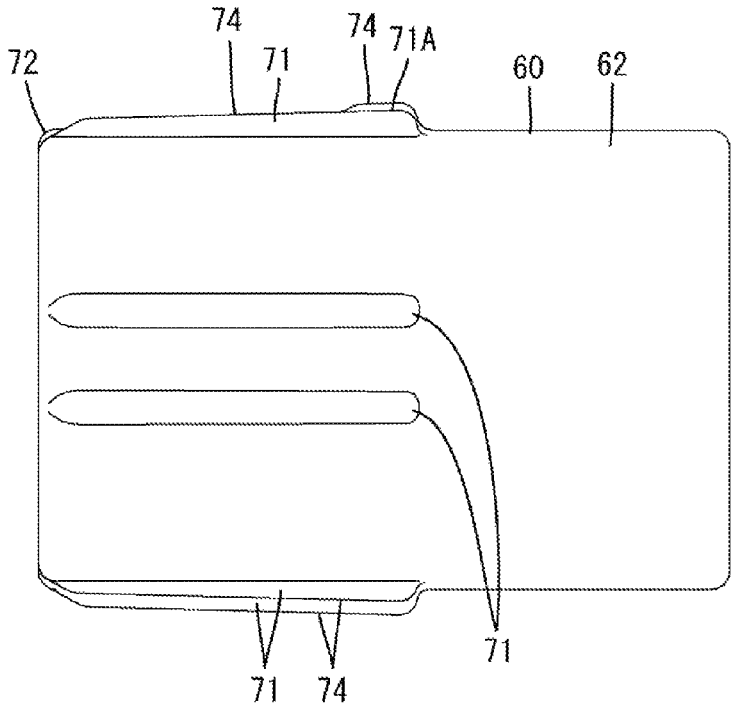
FIG. 7 is a side view of the front member.
Figure 8:
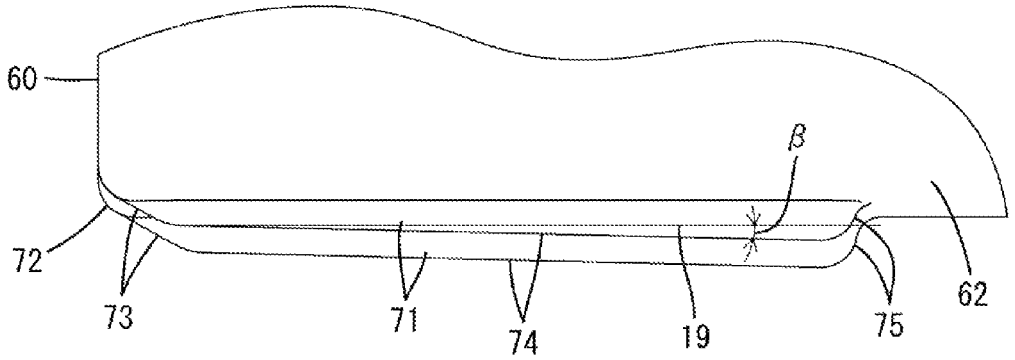
FIG. 8 is an enlarged view of an essential part of FIG. 7.

Each rib 71 is thickened gradually to increase a height from the front toward a rear. As shown in FIG. 8, a projecting tip of each rib 71 in the height direction has a start-end inclined portion 73 steeply inclined with respect to the front-back direction from the front toward the rear, an inclined portion 74 inclined at an angle of inclination β more moderate than the start-end inclined portion 73 with respect to the front-back direction from the rear of the start-end inclined portion 73 toward the rear, and a final end portion 75 steeply arranged to extend along the vertical direction from the rear end of the inclined portion 74. Note that, because the upper and lower surfaces of the peripheral wall 62 are curved outward in the widthwise central parts (see FIG. 5), the projecting tips of the ribs 71, 71A in the widthwise central part are located more outward than those of the ribs 71 located on opposite widthwise end parts as shown in FIGS. 7 and 8 when the front member 60 is viewed laterally. Further, as shown in FIG. 5, each rib 71 has a curved cross-sectional shape when viewed from the front and the projecting tip is on the top of an outwardly curved surface.

As shown in FIGS. 2 and 6, the short rib 71A has a shorter length in the front-back direction than the other ribs 71 and projects on the outer surface of the bridge 69. As shown in FIG. 2, the short rib 71A is composed of a start-end inclined portion 73, an inclined portion 74 and a final end portion 75 similarly to the other ribs 71 and formed similarly to the other ribs 71 except for an extending length of the inclined portion 74.

The angle of inclination β (see FIG. 8) of the inclined portion 74 of each rib 71 with respect to the front-back direction is substantially equal to the angle of inclination α (see FIG. 9) of the tapered surface 18 of the receptacle 12 with respect to the front-back direction. Thus, when the first and second housings 10, 30 are connected properly, the inclined portion 74 of each rib 71 comes substantially into line contact along the tapered surface 18 of the receptacle 12.

The front member 60 is assembled with the main body 31 from the front after the seal ring 43 is fit on the outer peripheral surface of the main body 31 of the second housing 30. As shown in FIG. 2, when the front member 60 is assembled properly, the locked portion 70 of the front member 60 is locked resiliently to the locking portion 44 of the main body 31 and the front member 60 is retained and held in the main body 31. Further, when the front member 60 is assembled properly, the corresponding retaining pieces 66 are inserted into the deflection spaces for the respective locking lances 35 and the female terminal fittings 40 are held in the cavities 34. Furthermore, the rear end of the peripheral wall 62 of the front member 60 is arranged to contact the front end of the seal ring 43, thereby preventing the seal ring 43 from coming out forward.

Subsequently, the main body 31 of the second housing 30 is fit together with the front member 60 into the receptacle 12 of the first housing 10. If connection axes of the first and second housings 10, 30 coincide in the process of connecting the first and second housings 10, 30, the front member 60 can be inserted into the receptacle 12 so that the projecting tip of each rib 71 does not contact the inner peripheral surface of the receptacle 12. Further, in a final stage of connecting the first and second housings 10, 30, the arm main body 48 of the lock arm 45 contacts the lock 16 and holds the seal ring 43 resiliently in close contact with the inner peripheral surface of the receptacle 12, thereby increasing connection resistance. However, the state where the projecting tip of each rib 71 is not in contact with the inner peripheral surface of the receptacle 12 can be maintained.

When the first and second housings 10, 30 are connected properly, as shown in FIG. 1, the front wall 61 of the front member 60 contacts the standing wall 11 and the lock arm 45 is locked resiliently to the lock portion 16 so that the first and second housings 10, 30 are held in the connected state. Further, as the first and second housings 10, 30 are connected properly, the inclined portion 74 of each rib 71 contacts the tapered surface 18 of the receptacle 12 to be pressed along an inclined line A (chain line of FIG. 1) corresponding to the mutual angles of inclination α, β, thereby preventing backlash between the first and second housings 10, 30. At this time, since each rib 71 has a curved surface cross-section, the projecting tip of each rib 71 is maintained in a contact state with the inner peripheral surface of the receptacle 12 without being squeezed. Further, except for the seal ring 43, only the ribs 71 come into contact with the inner peripheral surface of the receptacle 12 at this time.

As described above, according to this embodiment, the inclined portion 74 of each rib 71 contact along the tapered surface portion 18 of the receptacle 12 as the first and second housings 10, 30 are connected properly. Thus, sliding resistance due to a sliding movement of each rib 71 along the inner peripheral surface of the receptacle 12 is hardly produced and an operation burden is reduced in the process of connecting the first and second housings 10, 30. Further, the cross-section of the rib 71 perpendicular to the fitting direction (cross-section viewed from front) is a curved surface. Thus, a situation where the projecting tip part thereof is scraped off is unlikely during transportation and an intended backlash preventing function is exhibited. In addition, the inclined portion 74 of each rib 71 is in contact with the tapered surface 18 of the receptacle 12 without being squeezed when the first and second housings 10, 30 are connected properly. Thus, an operation force for squeezing the projecting tip of each rib 71 is not required and the operation burden reduced further.

The angle of inclination β of the inclined portions 74 of the ribs 71 with respect to the reference line 19 along the front-back direction and the angle of inclination α of the tapered surface 18 of the receptacle 12 with respect to the reference line 19 are substantially equal. Thus, a state where the inclined portions 74 of the ribs 71 and the tapered surface 18 of the receptacle 12 contact on the inclined line A corresponding to the angles of inclination α, β is ensured. As a result, backlash between the first and second housings 10, 30 is more satisfactorily suppressed.

The invention is not limited to the above described and illustrated embodiment. For example, the following modes are also included in the technical scope of the present invention.

The front member may be configured only to cover the front surface of the main body without having a retainer function of retaining the female terminal fittings.

The tapered surface has only to be inclined to reduce inner dimensions from the intermediate position of the inner peripheral surface of the receptacle in the front-back direction toward the rear side. For example, the rear end of the tapered surface portion may not reach the standing wall portion of the receptacle.

The ribs have only to be formed to gradually increase the height from the front end part of the peripheral wall portion of the front member toward the rear side. For example, the front ends (start ends) may be located behind the front end of the front member.

The angle of inclination of the inclined portions of the ribs with respect to the reference line along the front-back direction may be different from the angle of inclination of the tapered surface of the receptacle with respect to the reference line along the front-back direction.

LIST OF REFERENCE SIGNS

10 . . . first housing
11 . . . standing wall portion (back end)
12 . . . receptacle
18 . . . tapered surface portion
19 . . . reference line
30 . . . second housing
31 . . . main body
60 . . . front member
61 . . . front wall portion
62 . . . peripheral wall portion
71 . . . rib
74 . . . inclined portion
α . . . angle of inclination (of tapered surface portion)
β . . . angle of inclination (of rib)

What is claimed is:

1. A connector, comprising:

a first housing including a tubular receptacle;

a second housing including a main body having a front end to be fit into the receptacle and an outer peripheral surface;

a front member assembled over the outer peripheral surface and the front end of the main body to cover the front surface of the main body and fitted into the receptacle together with the main body; and ribs on the front member extending along a fitting direction of the main body into the receptacle being provided at a plurality of circumferentially spaced positions on the outer peripheral surface of the front member, the ribs being configured to suppress backlash between the first and second housings by contacting inner peripheral surface of the receptacle when the first and second housings are connected properly, wherein:

a tapered surface is provided on the inner peripheral surface of the receptacle and inclines in a direction to gradually reduce inner dimensions of the receptacle from an intermediate position of the receptacle in a depth direction toward a back end; and each rib has a curved surface cross-section perpendicular to the fitting direction, is formed to gradually increase a height from a front end part of the front member in the fitting direction toward a rear side and includes an inclined portion configured to contact along the tapered surface of the receptacle as the first and second housings are connected properly.

2. The connector of claim 1, wherein the inclined portions of the ribs and the tapered surface of the receptacle have substantially the same angle of inclination with respect to a reference line along the fitting direction.

3. The connector of claim 2, wherein the inclined portions of the ribs are in contact with the tapered portion of the receptacle without being squeezed when the first and second housings are connected properly.

4. The connector of claim 1, wherein the tubular receptacle includes an end wall and the inner peripheral surface projects forward from the end wall.

5. The connector of claim 1, wherein the tubular receptacle includes an outer peripheral surface and a lock projecting from an upper part of the outer peripheral surface.

6. The connector of claim 5, wherein a lock hole is formed in the main body of the second housing, and engages the lock of the tubular receptacle.

7. The connector of claim 5, wherein a front end of the tapered surface is forward of the lock.

8. The connector of claim 1, wherein the tapered surface has a constant angle of inclination with respect to an axis of the tubular receptacle.

9. The connector of claim 8, wherein a leading end of each of the ribs is inclined at a first angle of inclination greater than the constant angle of inclination of the tapered surface, and an inclined surface of each of the ribs rearward of the leading end is inclined at an angle equal to the constant angle of inclination of the tapered portion.

10. A connector, comprising:

a first housing including a tubular receptacle having an end wall and an inwardly-facing peripheral surface extending forward from the end wall, the inwardly-facing peripheral surface having a tapered portion inclined to gradually reduce inner dimensions of the tubular receptacle between an intermediate position of the receptacle and the end wall, the tapered portion having a constant angle of inclination with respect to an axis of the tubular receptacle; and a second housing to be fit into the receptacle in a fitting direction, the second housing including a main body and a front member covering a leading end of the main body in the fitting direction, a plurality of ribs provided at circumferentially spaced positions on an outer peripheral surface of the front member and extending along the fitting direction, each of the plurality of ribs having a curved surface cross-section perpendicular to the fitting direction, a leading end of each of the plurality of ribs inclined at a first angle of inclination greater than the constant angle of inclination of the tapered portion, and an inclined surface rearward of the leading end inclined at an angle equal to the constant angle of inclination of the tapered portion to gradually decrease a height of each of the plurality of ribs in the fitting direction toward a rear end and configured to contact along the tapered portion of the receptacle as the first and second housings are connected properly, wherein the tapered portion and the plurality of ribs are configured to suppress backlash between the first and second housings.

* * * * *